US005834676A

United States Patent [19]

Elliott

[11] Patent Number: 5,834,676

[45] Date of Patent: Nov. 10, 1998

[54] WEAPON-MOUNTED LOCATION-MONITORING APPARATUS

[75] Inventor: Larry J. Elliott, North Hollywood, Calif.

[73] Assignee: Sight Unseen, North Hollywood, Calif.

[21] Appl. No.: 689,649

[22] Filed: Aug. 12, 1996

[51] Int. Cl.[6] ..... F41G 5/06

[52] U.S. Cl. ..... 89/41.05; 42/100

[58] Field of Search ..... 89/41.05, 1.1; 42/100, 101, 103

[56] References Cited

U.S. PATENT DOCUMENTS

| | | | |
|---|---|---|---|
| 4,256,013 | 3/1981 | Quitadama | 89/41.05 |
| 4,386,848 | 6/1983 | Clendenin et al. | 356/5 |
| 4,884,137 | 11/1989 | Hanson et al. | 358/108 |
| 4,922,801 | 5/1990 | Jaquard et al. | 89/41.05 |
| 4,936,190 | 6/1990 | Pilcher, II | 89/41.05 |
| 5,200,827 | 4/1993 | Hanson et al. | 358/211 |
| 5,386,308 | 1/1995 | Michel et al. | 359/83 |

*Primary Examiner*—J. Woodrow Eldred

*Attorney, Agent, or Firm*—Fulwider Patton Lee & Utecht, LLP

[57] ABSTRACT

The apparatus enables a user to aim a weapon from a position of safety relative to a location to be monitored, and monitor the actions of a person at the location. It includes an imager for generating video images of the location and person being monitored, which imager is adapted to be mounted on the weapon. It further includes a viewer for receiving the video images generated by the imager so as to be viewed by the user, which viewer is adapted to be worn by the user. It also includes elements for electronically connecting the imager to the viewer, for receiving the video images of the location generated by the imager, processing the video images, and directly transmitting the processed video images to the viewer for viewing by the user of the location and person being monitored.

7 Claims, 3 Drawing Sheets

WEAPON-MOUNTED LOCATION-MONITORING APPARATUS

BACKGROUND OF THE INVENTION

1. Field of the Invention

This invention relates generally to remote video sighting systems. It relates specifically to an apparatus including a weapon-mounted portion for enabling a user to aim the weapon and monitor the actions of a person from a position of safety relative to the person being monitored.

2. Description of the Related Art

Previously, devices for enabling a user to aim a weapon and monitor the actions of a person from a position of safety were complex, cumbersome, and expensive.

A weapon-mounted system including a helmet-mounted video display, goggles on which an image of an object is holographically presented, a video camera mounted on the weapon, and a sight reticle superimposed on the target image, and in which the weapon is aimed by moving it until the target object is aligned with the sight reticle, is disclosed in U.S. Pat. Nos. 4,884,137; 4,970,589; 5,005,213; and 5,200,827.

However, such a system is complex, cumbersome, and expensive to operate.

A video camera mounted on a gunstock, and a line of sight lens structure for recording video information which an in-line gun-sight, is disclosed in U.S. Pat. No. 4,835,621. An optical system (rear sight) mounted on a gun-resembling member with a front sight, in which an image is reflected to a videocamera, is disclosed in U.S. Pat. No. 4,955,812.

An optical aiming instrument including a video recorder, transparent grid, and target mark, is disclosed in U.S. Pat. No. 3,798,796. A simulated firearm including a built-in camera for sportsman photography is disclosed in U.S. Pat. No. 4,630,911.

A rifle and motion picture combination system is disclosed in U.S. Pat. No. 3,427,102. A gun, motion picture camera, and telescope combination system is disclosed in U.S. Pat. No. 3,545,356. A gun frame and movable-lens-carrying camera assembly is disclosed in U.S. Pat. No. 3,877,048.

A high-resolution vision system including remote sensing cameras and a helmet-mounted display is disclosed in U.S. Pat. No. 4,028,725. Night-vision goggles are disclosed in U.S. Pat. No. 4,703,879.

However, these previous systems and devices did not enable a user to monitor a person at a location proximate the user, from a position of safety, in and efficient and effective manner.

SUMMARY OF THE INVENTION

The apparatus of the invention overcomes the above problems and others associated with prior systems and devices.

It comprises an apparatus including a portion adapted to be mounted on a weapon, for enabling a user to aim the weapon from a position of safety and monitor the actions of a person at a location proximate the user, in an efficient and effective manner.

It includes an imager, adapted to be mounted on the weapon, for generating video images of the person being monitored.

It further includes a viewer, adapted to be worn over the eyes of the user, for viewing the video images generated in the imager.

It also includes electronic elements, adapted to be mounted in a housing and worn on a beltpack, for receiving, processing, and directly transmitting video images from the imager to the viewer.

The electronic elements include elements for generating a cross-hair image superimposed on the video images in the viewer, elements for enabling adjustable positioning of the cross-hair image in the viewer, and elements for generating a reverse light or dark cross-hair image relative to the dark or light location viewed.

DESCRIPTION OF THE PREFERRED EMBODIMENT

Figure 1:
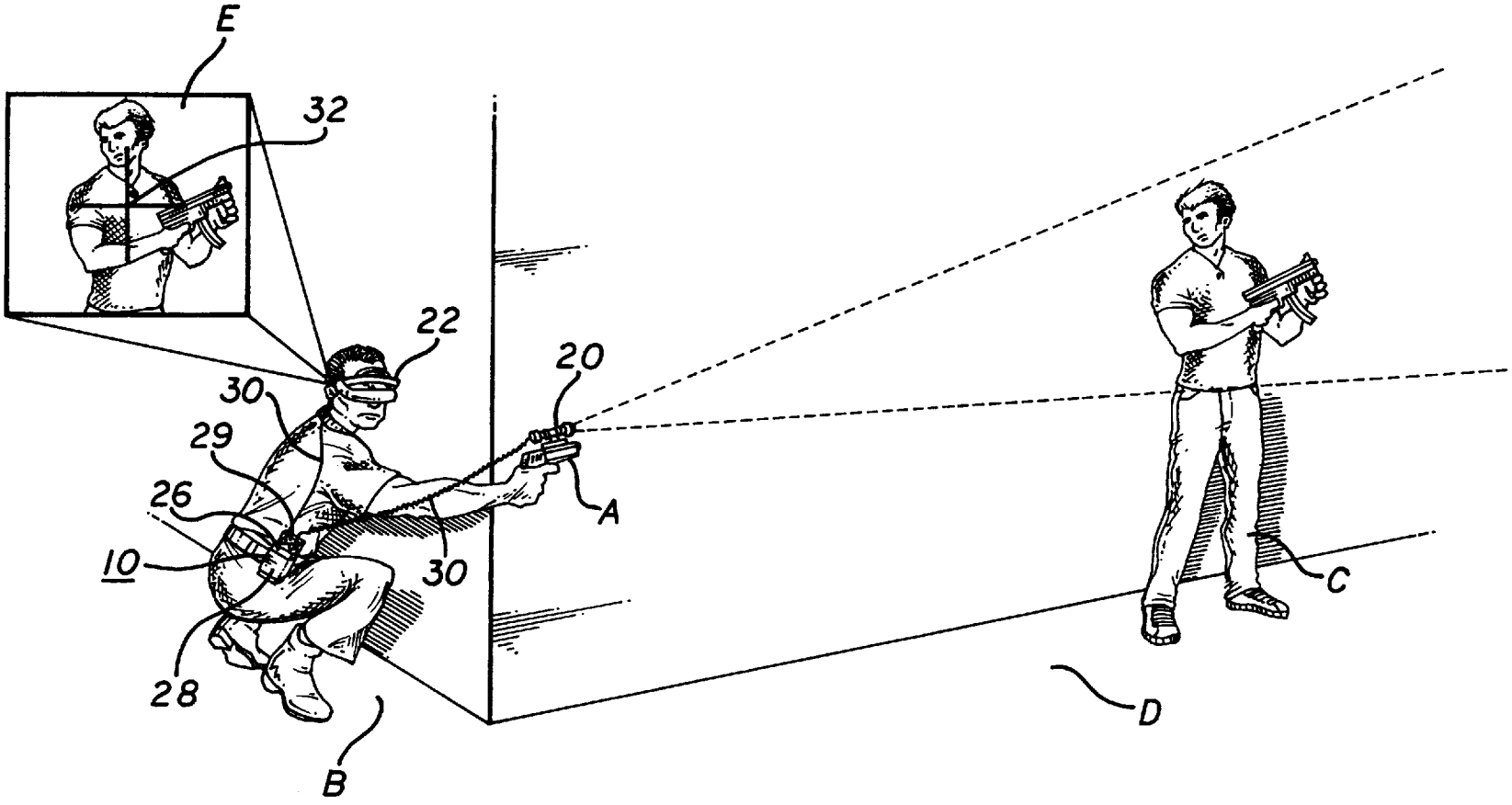
FIG. 1 a perspective view of the elements of the invention as worn by the user, with an exploded view of a video image as viewed by the user, and of a location to be monitored by the apparatus of the invention.

The invention comprises an apparatus 10, including a portion adapted to be mounted on a weapon A such as a gun, for enabling a user to aim weapon A from a position B of safety and monitor the actions of a person C at a location D proximate the user, as shown in FIG. 1. The user, such as a law enforcement officer, may point weapon A towards person C at location D, and view video images E of location D and person C, such as a criminal suspect, from hidden and safe position B, and may target and fire at person C if necessary.

Figure 2:
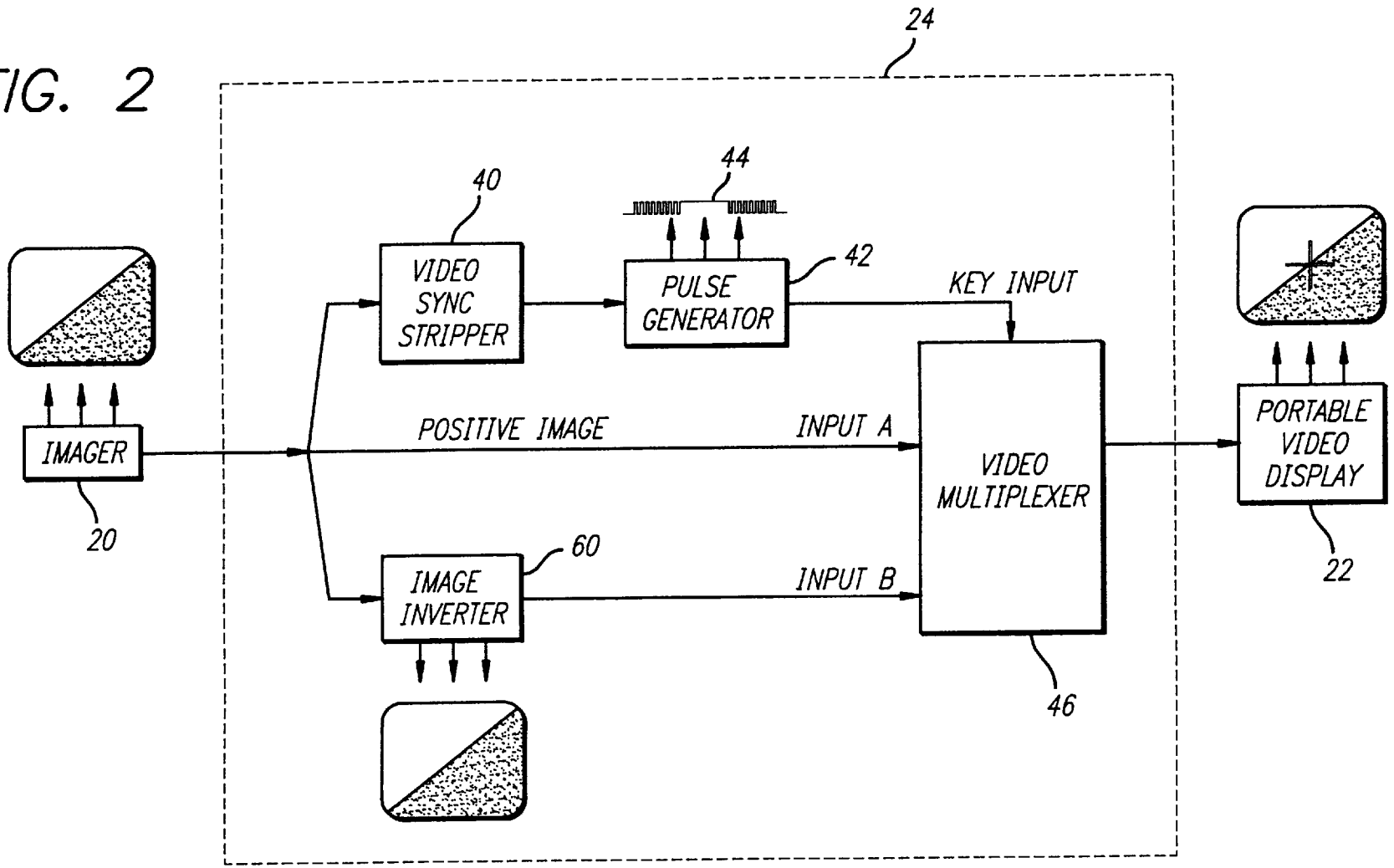
FIG. 2 is a block diagram of the elements of the apparatus of the invention.

Apparatus 10 includes an imager 20, adapted to be mounted on weapon A, and to generate video images E of location D, as shown in FIGS. 1 and 2. Imager 20 may comprise a video camera. It may include elements for generating video images in dark locations so as to be visible to the user, such as infra-red elements for nighttime vision.

Apparatus 10 further includes a viewer 22, adopted to be worn by the user, and to receive video images E generated by imager 20 for viewing by the user. Viewer 22 may comprise video glasses, including a portable video display.

Apparatus 10 also includes electronic elements 24, for electronically interconnecting imager 20 to viewer 22, adapted to be mounted in a housing 26 retained in a beltpack 28 to be worn by the user, and to receive video images E of location D generated by imager 20, to process the images, and to directly transmit the processed video images E to viewer 22 for viewing of location D by the user.

Electronic elements 24 include wires 30 for connecting imager 20 to viewer 22 therethrough. They further include an article 29 for generating portable power for elements 24, such as a battery.

Elements 24 also include elements for generating a cross-hair image 32, and for super-imposing cross-hair image 32 on video images E of location B generated in imager 20. The cross-hair elements include a video synchronization stripper 40, for extracting horizontal and vertical synchronization pulses from video images E generated by imager 22. They further include a pulse generator 42, which creates a series of timing pulses 44 from the horizontal and vertical synchronization pulses extracted by video synchronization stripper 40, which timing pulses are shown in FIGS. 2 and 4.

Pulse generator 42 is further adapted to enable the user to adjust the position of each pixel of cross-hair image 32 vertically and horizontally relative to video images E. Adjustment of each pixel of cross-hair image 32 is controlled by switches and potentiometers (not shown) on housing 26. A video multiplexer 46 arranges timing pulses 44 so as to form horizontal and vertical lines constituting cross-hair image 32, as shown in FIG. 3.

Figure 3:
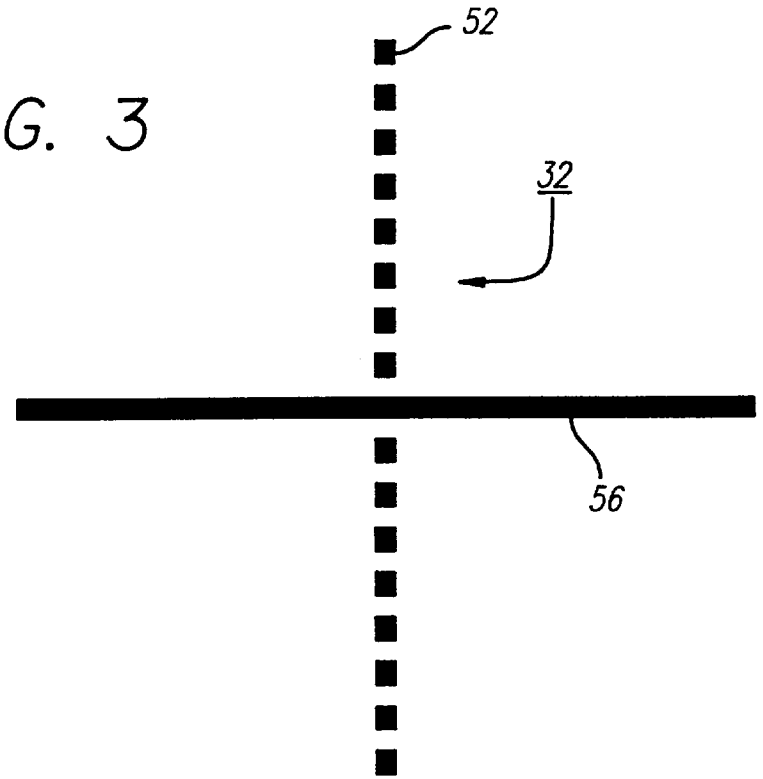
FIG. 3 is an elevational view of timing pulses arranged to form a cross-hair image by the apparatus of the invention.
Figure 4:
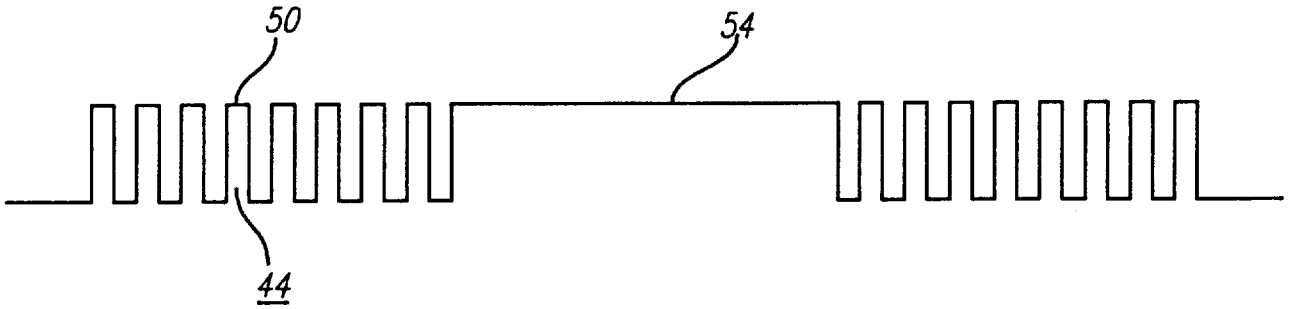
FIG. 4 is a fragmentary view of timing pulses generated by the apparatus of the invention.

Short timing pulses 50 from pulse generator 42 create small vertical dots arranged in a row to create a vertical line 52 for cross-hair image 32, as shown in FIGS. 3 and 4. Long timing pulse 54 creates a horizontal line 56 for cross-hair image 32.

Elements 24 still further include an image inverter 60, which creates the negative counterparts of video images E, and generates a reverse light or dark cross-hair image 36 relative to the dark or light image of location D being viewed. Video multiplexer 46 further replaces video images E with their negative counterparts when timing pulses 44 occur and for the length of time timing pulses 44 occur.

In operation, apparatus 10 enables a location D to be monitored by the user from a safe location. It is particularly useful in law enforcement operations, enabling an officer to see around corners without being exposed to possible danger. Apparatus 10 is battery operable so as to be portable and mobile.

The user may wear or carry all elements of apparatus 10. Imager 20, which may comprise a high resolution video camera, may be mounted in a military-style scope mounted on weapon A, which may be carried by the user. Viewer 22 and beltpack 28 may be worn by the user, with wires 30 interconnecting imager 20, viewer 22, and electronic elements 24 in beltpack 28.

The user, equipped with apparatus 10, may then be positioned at position of safety B, substantially hidden from person C at location D, and may extend weapon A with imager 20 thereon so as to view video images E of person C at location D, without otherwise being exposed to danger from person C. Video images E may then be monitored by the user through viewer 22. Cross-hair image 32 is superimposed on video images E, and is adjustable electronically relative to video images E by switches and potentiometer located in beltpack 28.

Electronic elements 24 receive video images E from imager 20, superimpose cross-hair image 32 on video images E, and deliver the composite signal to viewer 22. The vertical and horizontal positions of cross-hair image 32 are controllable by operating switches and potentiometers (not shown) on housing 26.

Cross-hair image 32 is reverse video, so as to be visible regardless of background. If the background is white, cross-hair image 32 will be black, and vice versa.

A preferred embodiment of the invention has been set forth above, for the purpose of explaining the invention. However, it is to be understood that variations in such embodiment may be made which are nevertheless within the scope and spirit of the invention as set forth in the claims.

I claim:

1. An apparatus which includes a portion adapted to be mounted on a weapon, for enabling a user to aim the weapon from a position of safety and monitor the actions of a person at a location proximate the position of the user, comprising:

(a) an imager, adapted to be mounted on the weapon and to generate video images of the location and person being monitored;

(b) a viewer, adapted to be worn by the user and to receive the video images generated by the imager for viewing by the user; and (c) means for electronically connecting the imager to the viewer, adapted to receive the video images of the location generated by the imager, to process the images, and to directly transmit the processed video images to the viewer for viewing by the user of the location and person being monitored, including means for generating a cross-hair image, and for super-imposing the cross-hair image on the video images of the location generated in the imager, including a pulse generator for generating timing pulses and arranging the timing pulses so as to form horizontal and vertical lines, and in which the cross-hair image comprises the horizontal and vertical lines.

2. An apparatus which includes a portion adapted to be mounted on a weapon, for enabling a user to aim the weapon from a position of safety and monitor the actions of a person at a location proximate the position of the user, comprising:

(a) an imager, adapted to be mounted on the weapon and to generate video images of the location and person being monitored;

(b) a viewer, adapted to be worn by the user and to receive the video images generated by the imager for viewing by the user; and (c) means for electronically connecting the imager to the viewer, adapted to receive the video images of the location generated by the imager, to process the images, and to directly transmit the processed video images to the viewer for viewing by the user of the location and person being monitored, including means for generating horizontal and vertical lines, including a video synchronization stripper, for extracting horizontal and vertical synchronization pulses from the video images generated by the imager.

3. An apparatus which includes a portion adapted to be mounted on a weapon, for enabling a user to aim the weapon from a position of safety and monitor the actions of a person at a location proximate the position of the user, comprising:

(a) an imager, adapted to be mounted on the weapon and to generate video images of the location and person being monitored;

(b) a viewer, adapted to be worn by the user and to receive the video images generated by the imager for viewing by the user; and (c) means for electronically connecting the imager to the viewer, adapted to receive the video images of the location generated by the imager, to process the images, and to directly transmit the processed video images to the viewer for viewing by the user of the location and person being monitored, including means for generating horizontal and vertical lines, including means for arranging video signal timing pulses to generate the horizontal and vertical lines.

4. An apparatus as in claim 2, in which the connecting means further include a pulse generator for creating a series of timing pulses synchronous with the synchronization pulses extracted by the video synchronization stripper.

5. An apparatus as in claim 2, in which the pulse generator is further adapted to enable vertical and horizontal adjustment of the synchronization pulses relative to the video images.

6. An apparatus as in claim 3, in which the connecting means further include an image inverter, for creating the negative counterpart of the video image.

7. An apparatus as in claim 6, in which the connecting means further include a video multiplexer, for replacing the video images with their negative counterpart, when the timing pulses occur, and for the length of time the timing pulses occur.

* * * * *